US006848678B2

(12) United States Patent
Reiff

(10) Patent No.: US 6,848,678 B2
(45) Date of Patent: Feb. 1, 2005

(54) FENCE TENSIONER

(75) Inventor: Jason T. Reiff, Florence, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 27 days.

(21) Appl. No.: 10/326,126

(22) Filed: Dec. 23, 2002

(65) Prior Publication Data

US 2004/0119059 A1 Jun. 24, 2004

(51) Int. Cl.[7] ..... E04H 17/02

(52) U.S. Cl. ..... 256/44; 256/32; 256/37; 256/40; 256/42

(58) Field of Search ..... 256/1, 10, 32, 256/37, 40–44, 46, 47; 242/388.2, 388.3, 388.4; 254/213, 225, 217–220, 222

(56) References Cited

U.S. PATENT DOCUMENTS

| | | | | | |
|---|---|---|---|---|---|
| 83,038 | A | | 10/1868 | Chaplin | |
| 172,460 | A | | 1/1876 | Lightfoot | |
| 301,037 | A | | 6/1884 | Worcester | |
| 393,504 | A | | 11/1888 | Fuller | |
| 402,439 | A | | 4/1889 | Haas | |
| 417,993 | A | | 12/1889 | Doud | |
| 420,819 | A | | 2/1890 | Merchant | |
| 445,330 | A | | 1/1891 | Kiler | |
| 472,927 | A | * | 4/1892 | Kidd | 254/214 |
| 473,899 | A | | 5/1892 | Berdan | |
| 476,655 | A | | 6/1892 | Kintner | |
| 499,279 | A | | 6/1893 | Bird | |
| 516,040 | A | | 3/1894 | Wyssinger et al. | |
| 591,732 | A | | 10/1897 | Bohner | |
| 596,987 | A | | 1/1898 | Diller | |
| 658,671 | A | | 9/1900 | Northrup | |
| 664,771 | A | | 12/1900 | McCallum | |
| 828,382 | A | | 8/1906 | Campbell | |
| 850,612 | A | | 4/1907 | Beltzer | |
| 1,250,631 | A | | 12/1917 | Novess | |
| 1,982,444 | A | * | 11/1934 | Miller | 242/388.2 |
| 1,998,185 | A | | 4/1935 | Broderick | |
| 2,429,590 | A | | 10/1947 | Ames | |
| 2,527,877 | A | | 10/1950 | Docken | |
| 4,465,263 | A | | 8/1984 | Robbins, Jr. | |
| 4,706,942 | A | | 11/1987 | Robbins, Jr. | |
| 6,070,823 | A | * | 6/2000 | Clary | 242/388.1 |
| 6,152,429 | A | | 11/2000 | Pettigrew | |
| 6,431,487 | B1 | * | 8/2002 | Wall | 242/388.2 |
| 6,648,305 | B2 | * | 11/2003 | House et al. | 256/40 |

* cited by examiner

*Primary Examiner*—Daniel P. Stodola
*Assistant Examiner*—Michael P. Ferguson
(74) *Attorney, Agent, or Firm*—Nixon & Vanderhye P.C.

(57) ABSTRACT

A fence tensioner includes a bracket adapted to be secured to a fence post, the bracket having upper and lower horizontal plate portions with vertically aligned cylinder openings and vertically aligned locking pin reaction holes therein. A tensioning cylinder is received in the vertically aligned cylinder openings for rotation relative to the upper and lower horizontal plate portions, the tensioning cylinder having at least one slot extending along the cylinder for receiving a fence slat, and flanges at opposite ends thereof that retain the tensioning cylinder in the aligned cylinder openings. Each of the flanges has a circular array of selectively useable locking apertures therein. The upper flange is provided with a profiled opening for receiving a similarly profiled tool for rotating the cylinder. A locking pin is provided that is adapted to extend through the aligned locking pin reaction holes and through a selected pair of aligned locking apertures to lock the fence slat in the tensioned position.

15 Claims, 12 Drawing Sheets

FENCE TENSIONER

BACKGROUND OF THE INVENTION

This invention relates to fence tensioners especially designed for use with flexible polymer fence slats.

Fences are the most commonly employed means for confining that which would otherwise escape and excluding that which would otherwise intrude. Fences may vary greatly in both structure and materials of composition. Common fence structures include wire fences, such as barbed wire and chain link, and wood fences such as, picket fences and split rail fences. Common fence materials include metal, wood and stone. Fence structure and composition are selected on the basis of initial and upkeep costs, durability, strength, aesthetic characteristics, and safety desired or required.

One very common form of fencing is barbed wire. The relatively low cost of purchasing, installing, and maintaining barbed wire fencing has made it the preeminent fencing material for enclosing livestock areas. Barbed wire suffers from the disadvantage, however, that its sharp barbs may cut or gouge the hide of valuable livestock. Furthermore, barbed wire has a very thin cross-section so that it is not easy to see; and an animal is correspondingly more apt to contact a barbed wire fence than it would be to contact a more visible barrier. Other types of wire fencing known in this art, such as web wire fencing, and cyclone wire fencing, suffer from similar limitations. These wire fences also tend to have poor aesthetic qualities and they tend to rust or corrode after a few years of service. Fences made entirely of wood, on the other hand, are typically safer and more pleasing to the eye, but are expensive to install and maintain.

Over the past several years, composite metal and plastic fence systems have become increasingly accepted for the confinement of livestock, thoroughbred horses and the like. Typically, the fence slats are comprised of at least two wires or other high strength fibers encased in a polymer such as vinyl or other suitable plastic web. Depending on the width of the fence slat, two wires may extend along the opposite edges of the slat or, for wider slats, a third wire may be added intermediate the edge wires. Examples of such fencing construction can be found in U.S. Pat. Nos. 4,465,263 and 4,706,942.

To maximize the effectiveness of the flexible fence slats, tensioning devices must be utilized to insure that the individual slats do not sag between posts. Fence tensioners have long been used to tighten individual strands in wire fence systems. Examples may be found in U.S. Pat. Nos. 393,504; 420,819; 473,899; 516,040; 596,987; 658,671. A fence tensioner for polymer fence slats is disclosed in the more recently issued U.S. Pat. No. 6,152,429.

BRIEF DESCRIPTION OF THE INVENTION

The present invention relates to an improved fence tensioner designed especially for use with flexible polymer fence slats with reinforcing wires embedded therein. In one exemplary embodiment, a tensioning cylinder is mounted for rotation in a pair of bracket flanges formed in respective discrete attachment webs. The attachment webs are designed for adjustment at the manufacturing stage to change the distance between the bracket flanges to accommodate tensioning cylinders of different lengths, thus allowing the tensioning device to be used with fence slats of different widths. Once the appropriate cylinder has been located between the flanges, with integral axle stubs received in aligned holes in the flanges, the attachment webs of the bracket assembly are riveted or otherwise permanently secured to each other.

In this embodiment, the tensioning cylinder has a smooth peripheral surface with annular grooves located so as to correspond with the location of the embedded wires in the fence slat. A longitudinal slot through the cylinder is designed to receive a free end of the fence slat, without having to strip the plastic from the ends of the reinforcing wires. An integral ratchet wheel is formed on the cylinder, inside and adjacent one of the bracket flanges. Teeth on the ratchet wheel are adapted to be engaged by a pawl pivotally mounted on the bracket flange. This is a conventional ratchet and pawl arrangement that permits rotation of the ratchet wheel in a tensioning direction but prevents rotation in an opposite or tension release direction. In this regard, the pawl may be spring biased into engagement with the ratchet wheel, or may be manually moved into or out of engagement by means of a finger tab.

In a variation of the first embodiment of the invention, a larger bracket assembly is provided that mounts a pair of tensioning cylinders at opposite ends thereof. The adjustability feature at the manufacturing stage for accommodating cylinders of different lengths is maintained.

In a second exemplary embodiment of the invention, a pair of tensioning cylinders are rotatably mounted between fixed upper and lower, horizontal plate portions of the bracket, with flanges on opposite ends of the tensioning cylinders retaining the latter in place. The flanges have profiled apertures therein that are centered on the longitudinal axis of the respective tensioning cylinder, and that are adapted to receive a complementary tool head for rotating and thus tightening or tensioning the fence slat. Each tensioning cylinder may be a hollow tube with one or more slots for receiving the fence slat. Alternatively, the tensioning cylinder may be comprised of a pair of generally semicircular segments that, when assembled, form cylinder segments that are sandwiched about an end of the fence slot.

In addition, the upper and lower plate portions of the bracket have one or more aligned pairs of locking pin reaction holes, while the tensioning cylinder flanges are each provided with a circular array of aligned locking pin apertures. This allows the user to insert an elongated locking pin through the plate portions and the tensioning cylinder flanges when the fence slat has been tensioned to the desired degree to thereby lock the tensioning cylinder against rotation in the tightened or tensioned position.

Accordingly, in its broader aspects, the invention relates to a fence tensioner comprising a bracket adapted to be secured to a fence post, the bracket having upper and lower horizontal plate portions with vertically aligned cylinder openings and vertically aligned locking pin reaction holes therein; a first tensioning cylinder received in the vertically aligned cylinder openings for rotation relative to the upper and lower horizontal plate portions, the first tensioning cylinder having at least one slot extending along the shaft and a first pair of flanges at respective opposite ends thereof that retain the tensioning cylinder in the aligned cylinder openings, each of the first pair of flanges having a circular array of selectively useable locking apertures therein; and a locking pin adapted to extend through the aligned locking pin reaction holes and through a selected pair of aligned locking apertures.

In another aspect, the invention relates to a fence tensioner comprising a bracket adapted to be secured to a fence post, the bracket having upper and lower horizontal plate portions with vertically aligned cylinder openings and vertically aligned locking pin reaction holes therein; a tensioning cylinder received in the vertically aligned cylinder openings for rotation relative to the upper and lower horizontal plate portions, the tensioning cylinder formed by a pair of adjacent, elongated and generally semi-circular segments, secured to and between a pair of end flanges, such that a fence slat receiving slot is formed between the segments, each of the end flanges having a circular array of selectively useable locking apertures therein; and a locking pin adapted to extend through the aligned locking pin holes and through a selected pair of aligned locking apertures.

The invention will now be disclosed in further detail in connection with the drawings described below.

DETAILED DESCRIPTION OF THE INVENTION

Figure 1:
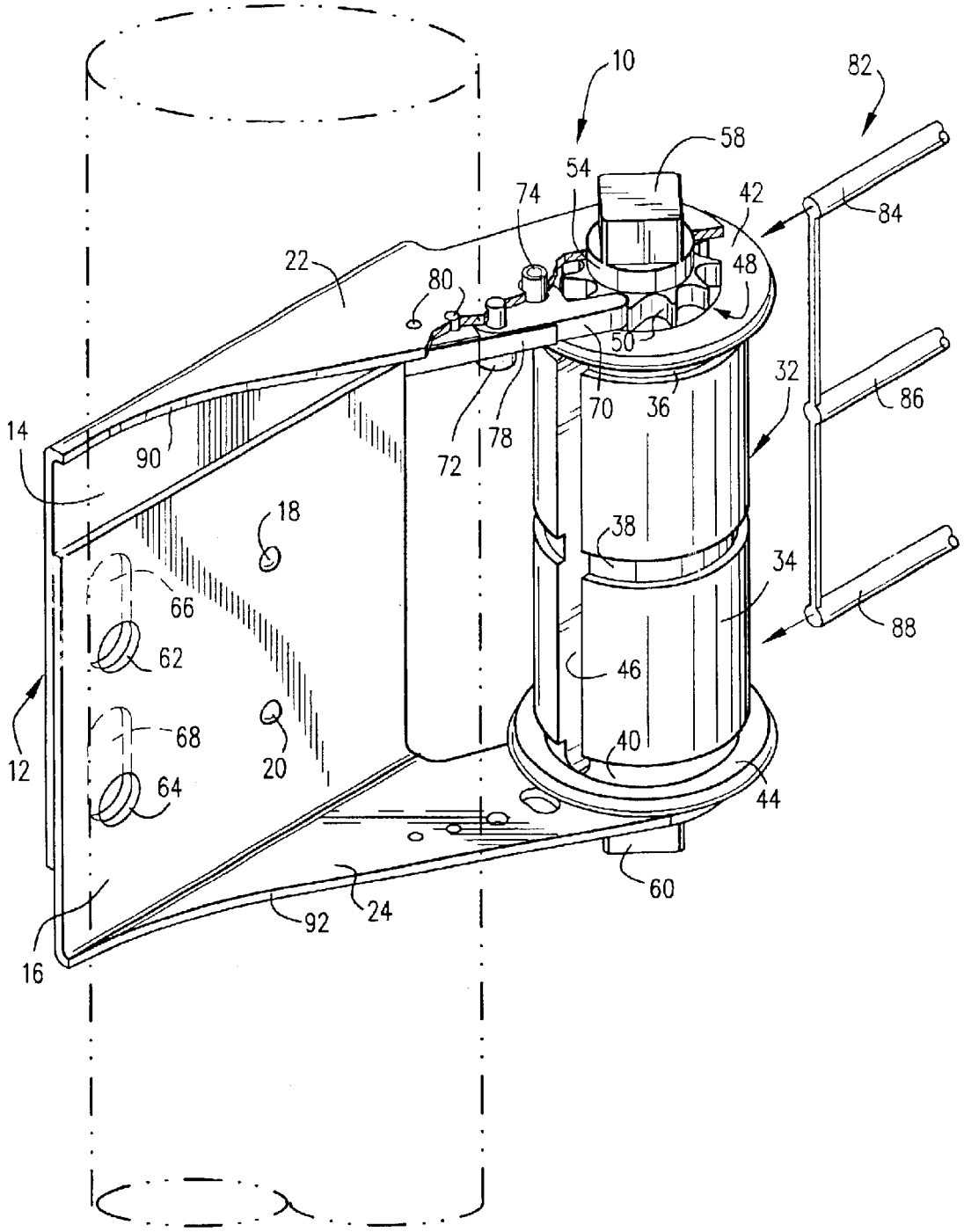
FIG. 1 is a perspective view of a fence tensioner in accordance with the first exemplary embodiment of the invention.
Figure 2:
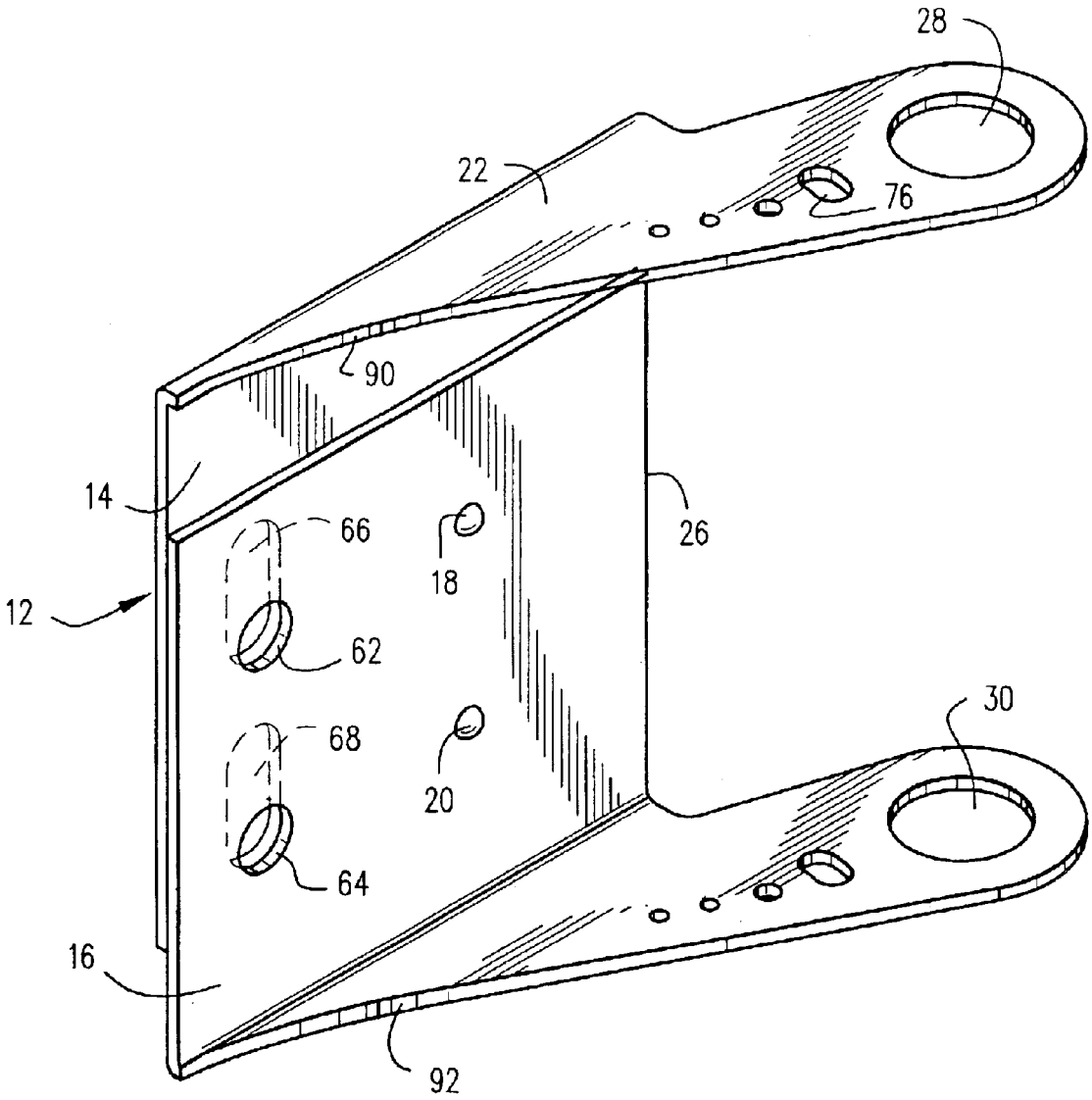
FIG. 2 is a perspective view of the bracket assembly taken from the fence tensioner shown in FIG. 1.
Figure 3:
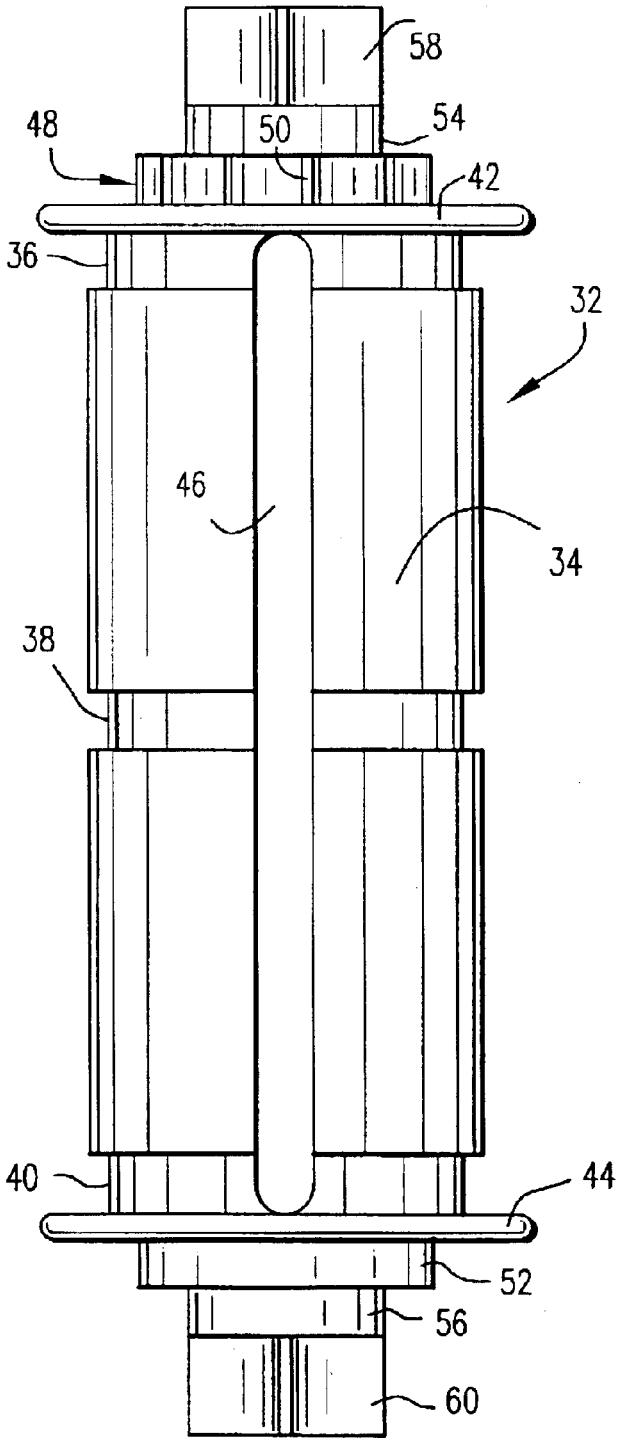
FIG. 3 is a side elevation of the tensioning cylinder taken from the fence tensioner shown in FIG. 1.
Figure 4:
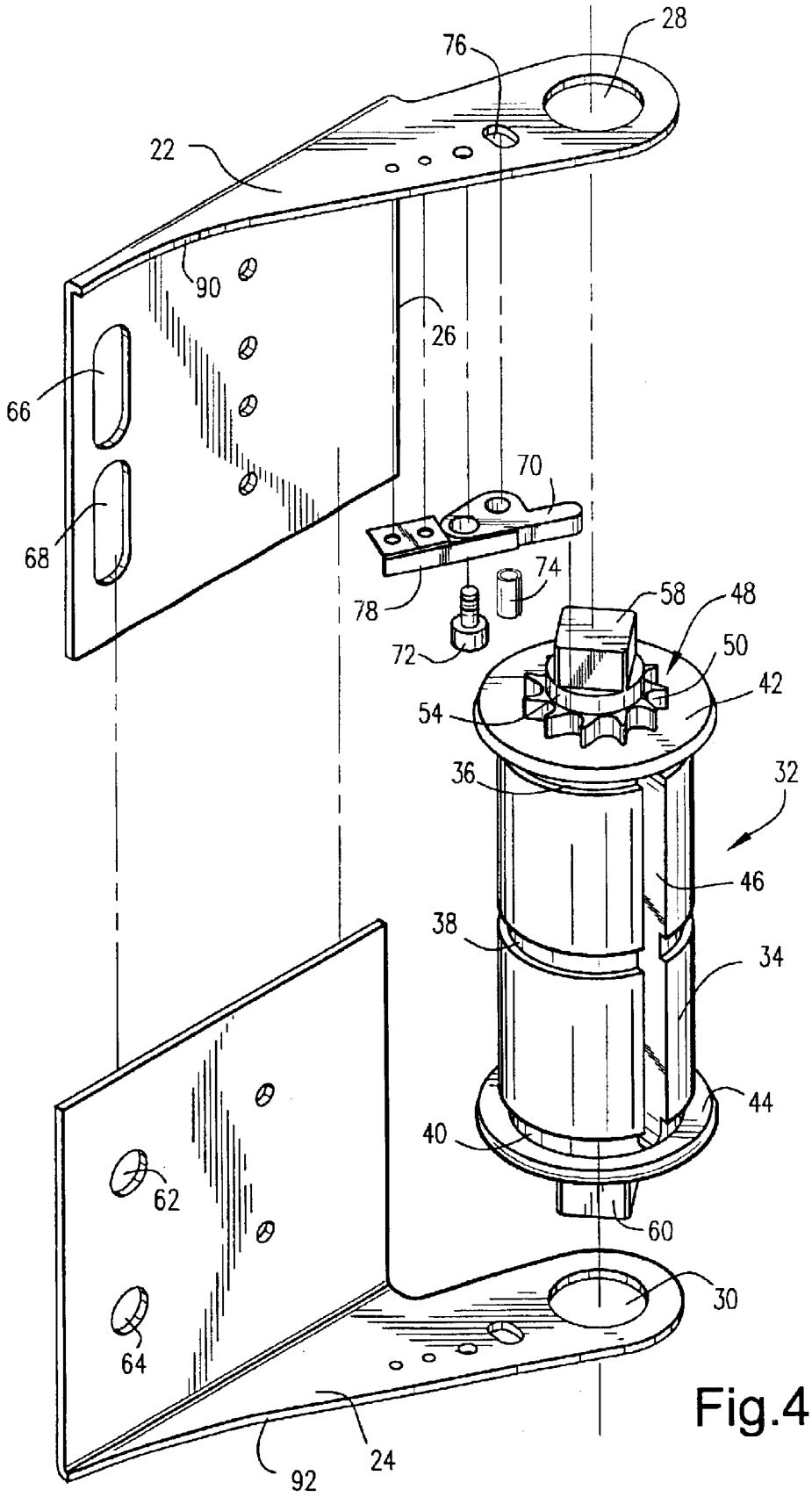
FIG. 4 is a perspective exploded view of the fence tensioner shown in FIG. 1.

The fence tensioner 10 includes a bracket assembly 12 that includes first and second vertically oriented attachment webs 14, 16 in back-to-back relationship, permanently secured to each other by means of rivets 18, 20 or other suitable means. The webs are formed with respective horizontally oriented flanges 22, 24 along upper and lower edges of the webs, and extending beyond side edges 26 of the webs. The horizontally oriented flanges 22, 24 are formed with respective vertically aligned holes 28, 30 that serve to mount a tensioning cylinder 32 as described further below.

The tensioning cylinder 32 has a substantially smooth fence slat engaging peripheral surface 34, with annular machined grooves 36, 38 and 40 at respective upper, middle and lower portions of surface 34. Adjacent the grooves 36 and 40, radial flanges 42, 44 are formed, with diameters greater than the diameter of the surface 34. The grooves 36, 38 and 40 are adapted to receive the longitudinally extending ridges on the fence slat that correspond to the location of the reinforcing wires embedded in the slat. Thus, the grooves 36, 38 and 40 along with the flanges 42, 44 confine the slat and insure that it is wound straight on the tensioning cylinder 32. To secure the slat to the cylinder 32, the latter is provided with a longitudinal through-slot 46 that extends between flanges 42, 44.

To the outside of flange 42, an integral ratchet wheel 48 is formed with teeth 50 extending from a solid center hub. To the outside of flange 44, a solid cylindrical blank section 52 is formed, having a diameter similar to that of ratchet wheel 48. Reduced diameter axle stubs 54, 56 extend from the ratchet wheel 48 and blank section 52, respectively, with respective multi-sided tool heads 58, 60 at opposite remote ends of the tensioning cylinder 32.

During assembly, the flanges 22, 24 of the bracket are located such that axle stubs 54, 56 are seated within holes 28, 30, respectively, in the bracket flanges 22, 24. The two bracket webs 14, 16 are then secured together via the rivets 18, 20 or other suitable fasteners, thereby locking the tensioning cylinder 32 in place, for rotation about the longitudinal axis of the cylinder, i.e., the cylinder turns with its axle stubs 54, 56 rotating within the apertures 28, 30.

Holes 62, 64 in web 16 align with slots 66, 68 in web 14 to permit the tensioner to be secured to a fence post by suitable fasteners.

It will also be appreciated that by employing slots 66, 68 on one of the webs, the bracket can be "opened" or "closed" to accept tensioning cylinders 32 of different lengths, minimizing the components necessary to accept various fence slat widths. The bracket assembly as shown in FIG. 1 is in the "open position" to accept, e.g., a tensioning cylinder designed for a five inch wide slat. When closed, a tensioning cylinder designed to accommodate a smaller width slat (e.g., a four inch wide slat) may be used with the same bracket assembly.

A pawl lever 70 is pivotally secured to the bracket flange 22 via finger adjustable screw 72 and located such that the tip of the pawl lever is adapted to engage the ratchet wheel 48 between adjacent pairs of teeth 50. As is well known in the art, the ratchet wheel 48 and pawl 70 are configured and arranged to permit rotation of the cylinder 32 in a fence slat tensioning direction but not in an opposite or release direction. This insures that the fence slat will remain tensioned after the tightening steps are complete. A finger tab 74 on the pawl extends through an arcuate slot 76 in the flange 22. This allows the user to pivot the pawl 70 into or out of engagement with the ratchet wheel 48. Finger screw 72 is utilized to provide the desired resistance to rotation in the pawl. It will be appreciated that the pawl 70 could be biased into a wheel engaging position by a leaf spring 78 (or the like) secured via pins 80 to the flange 22, but it is not necessary to do so.

In use, a flexible fence slat 82 reinforced by wires embedded at 84, 86 and 88 is inserted into the slot 46 and a wrench or other torque applying tool is located over one of the heads 58 or 60. With the pawl 70 moved to a ratchet engaging position, the tensioning cylinder 32 is rotated to wind the slat about the cylinder and thus tension the slat to the desired degree. The wrench or other tool is then removed, with the pawl 70 remaining fully engaged between two adjacent teeth 50 on the ratchet wheel 48 to thus prevent back rotation of the cylinder.

As indicated above, the bracket assembly 12 will accommodate tension cylinders 32 of different lengths. For slats of lesser width, e.g., 4 inches, the reinforcing wires may be confined to the upper and lower edges of the slat and thus the middle groove 38 on the cylinder 32 can be omitted.

Figure 7:
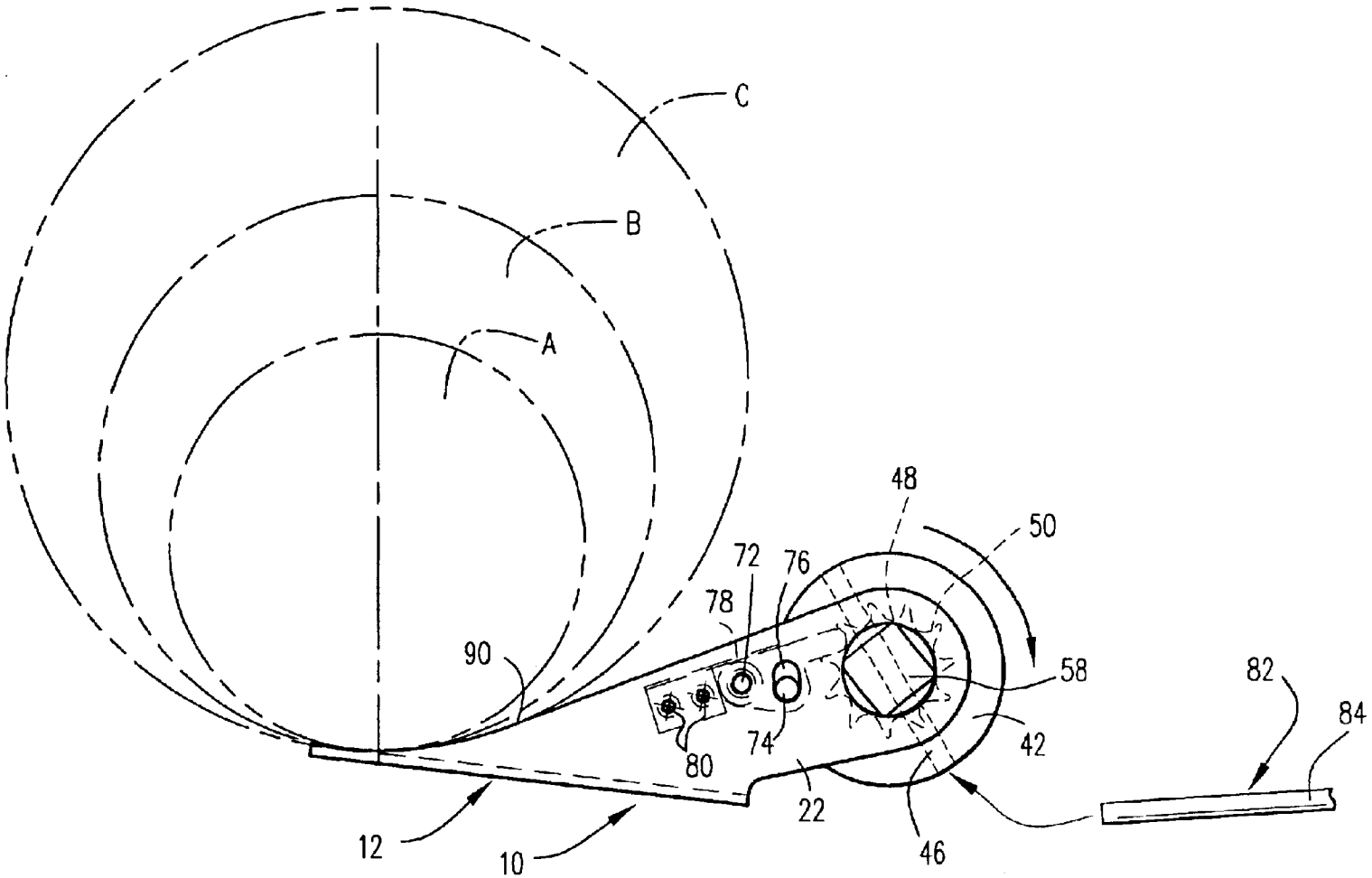
FIG. 7 is a plan view of the fence tensioner shown in FIG. 1, illustrating how the fence tensioner is adapted for use with fence posts of different diameters.
Figure 8:
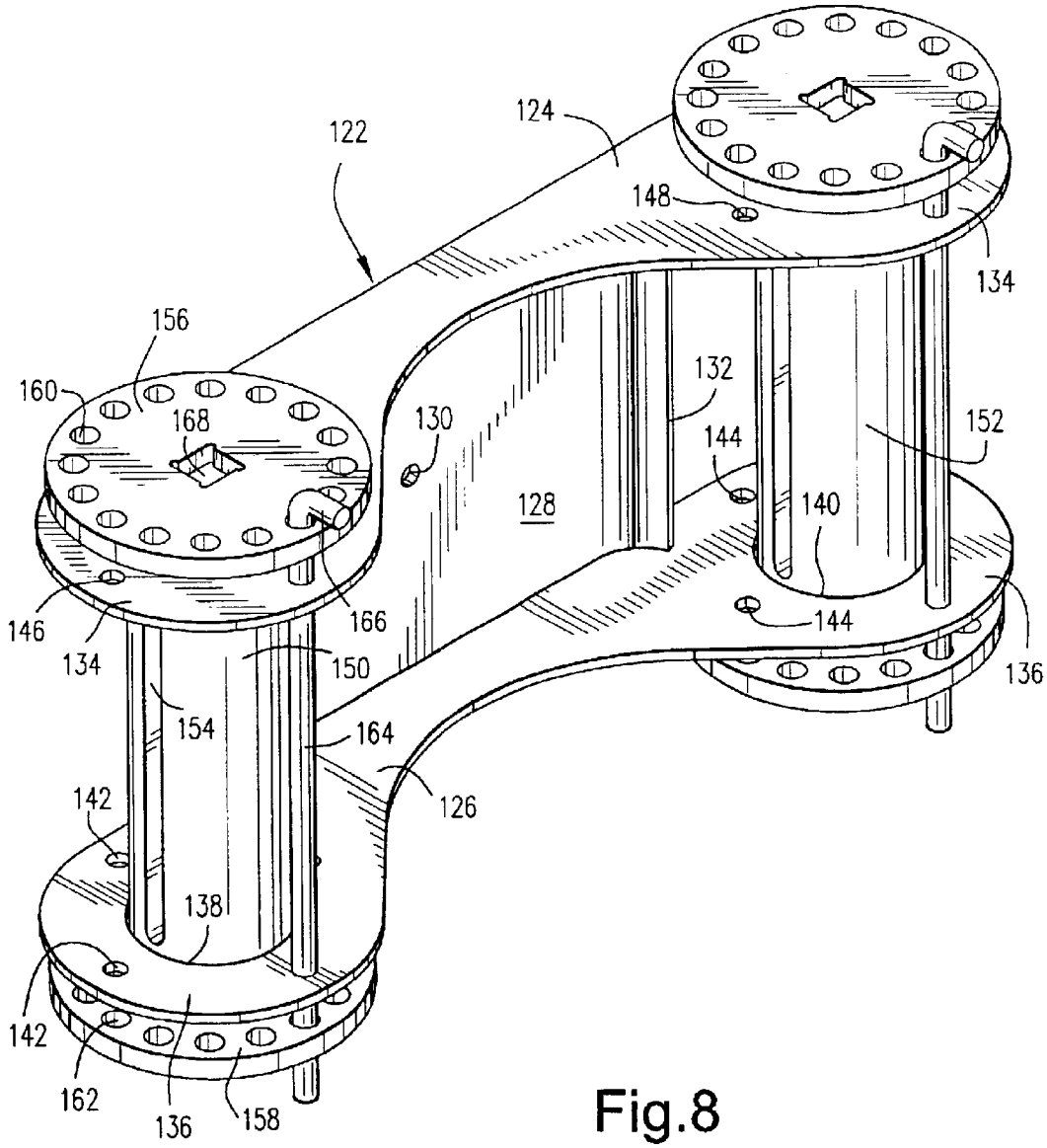
FIG. 8 is a perspective view of a fully assembled fence tensioner in accordance with a second exemplary embodiment of the invention.
Figure 9:
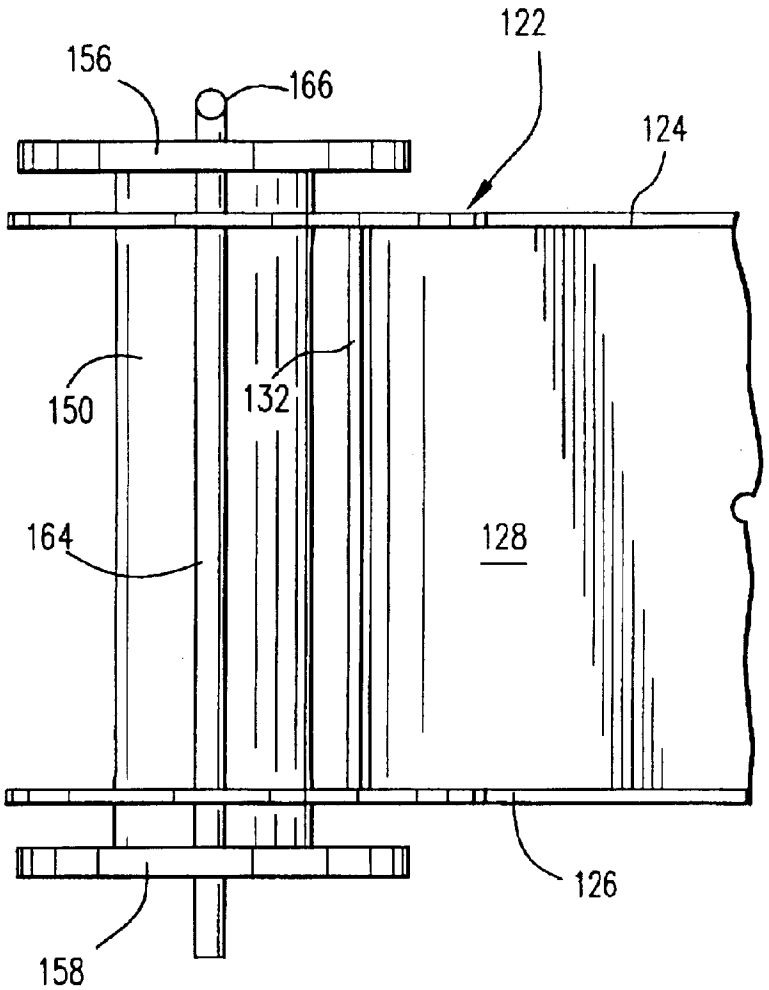
FIG. 9 is a front elevation of one side of the fence tensioner shown in FIG. 8.
Figure 10:
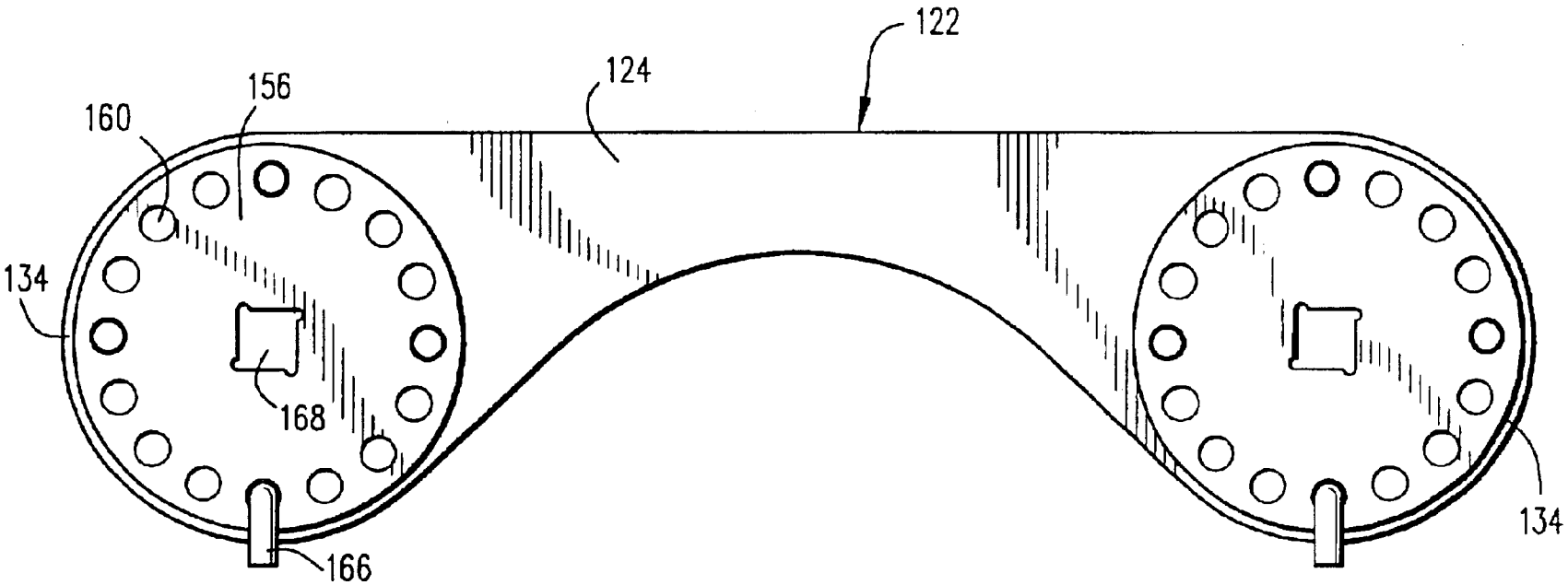
FIG. 10 is a plan view of the fence tensioner shown in FIG. 8.

The web arrangement and particularly the widely curved edges 90, 92 along flanges 22, 24 permit the bracket to be secured to square, rectangular or round fence posts A, B, C or D of various diameters (see FIG. 7).

Figure 5:
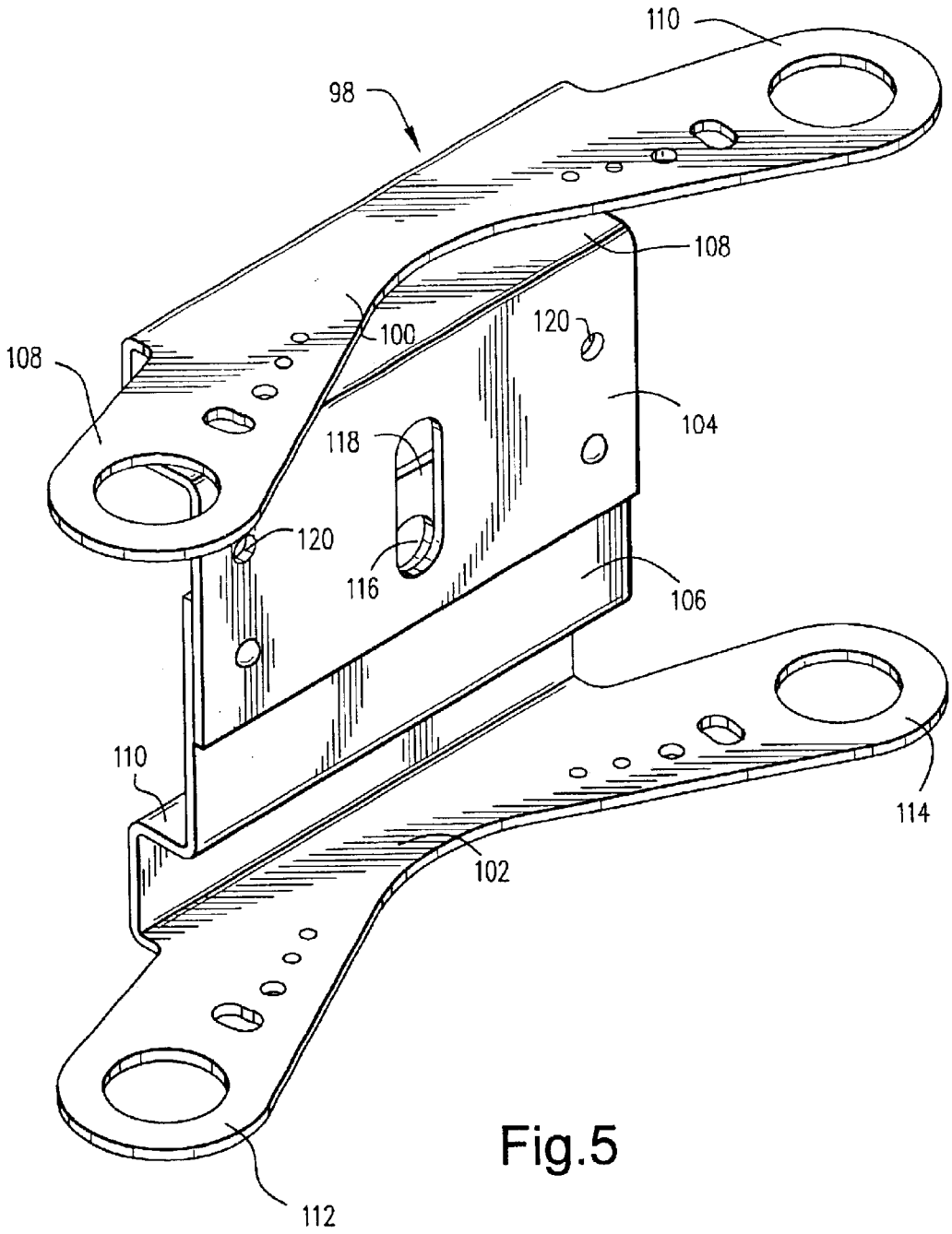
FIG. 5 is a perspective view of a bracket assembly for a fence tensioner in accordance with a variation of the first exemplary embodiment of the invention.
Figure 6:
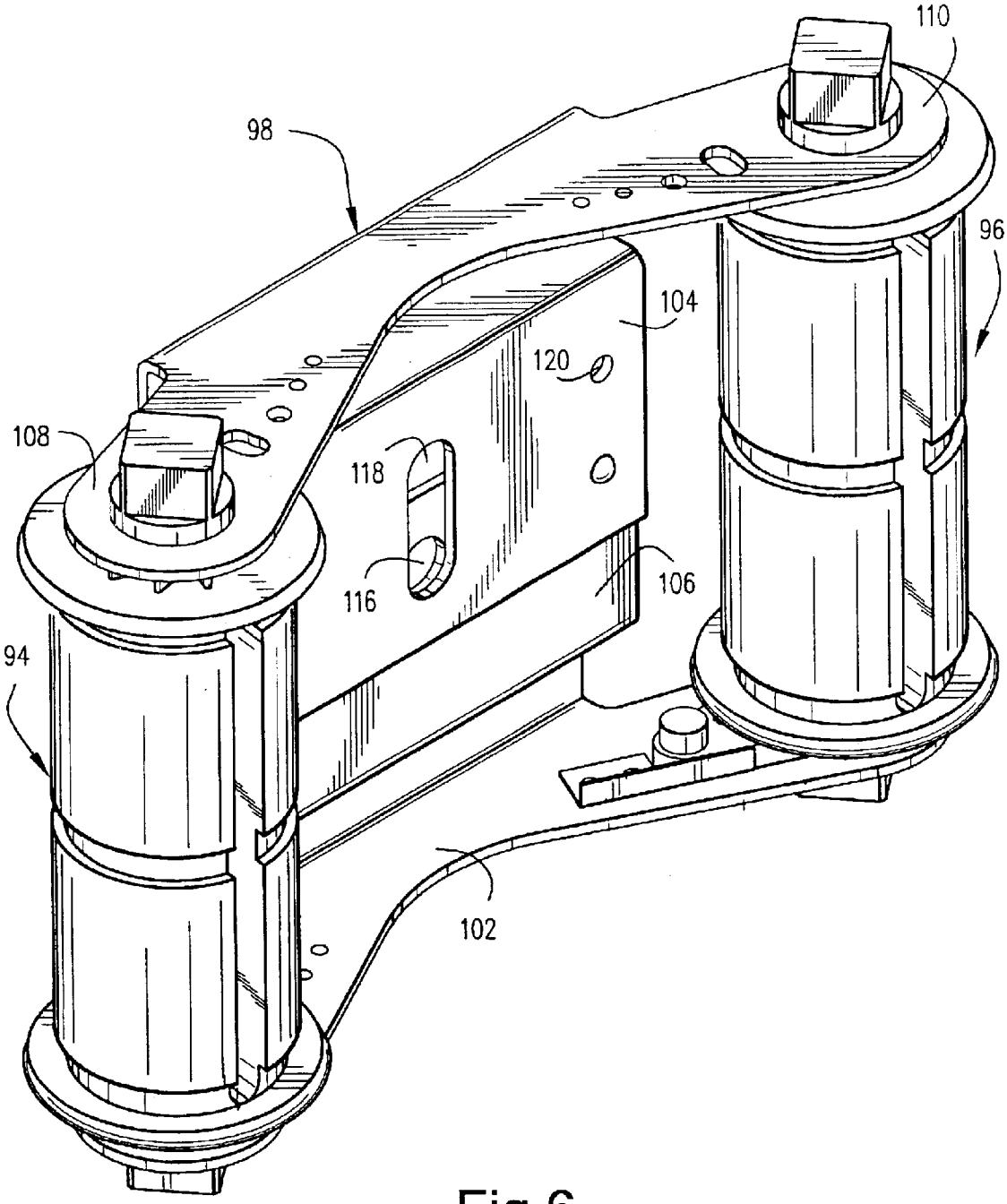
FIG. 6 is a perspective view of a fully assembled fence tensioner utilizing the bracket assembly of FIG. 5.

FIGS. 5 and 6 illustrate a variation of the embodiment shown in FIGS. 1–4 where a pair of tensioning cylinders 94, 96 are supported on opposite ends of an enlarged bracket assembly 98. The cylinders 94, 96 are identical to cylinder 32 and need not be described further.

The bracket assembly 98 is also similar to bracket assembly 12, but horizontal flanges 100, 102 on respective attachment webs 104, 106 are extended to include mirror image cylinder attachment ends 108, 100 on flange 100 and 112, 114 on flange 102. The attachment webs 104, 106 each have offsets or shoulders 108, 110 but are otherwise similar to webs 14, 16. Thus, the use of hole 116 and slot 118 allow the webs to be moved between open and closed positions to accept cylinders of different lengths, and selected rivet holes 120 are used to secure the webs after the cylinders 96 are in place. The ratchet and pawl arrangement remains as described above.

The double tensioner shown in FIGS. 5 and 6 is useful on any post where free ends of fence slats meet, whereas the fence tensioner shown in FIGS. 1–4 and 7 is useful particularly on termination posts.

Turning now to FIGS. 8–12, a further and preferred exemplary embodiment includes a fence tensioner bracket 122 that includes upper and lower horizontal plate portions 124, 126 with a vertically arranged web 128, bent or welded to, and extending between the plate portions, along rearward edges of the plate portions. The vertical web may be formed with a centrally located aperture 130 to facilitate attachment of the bracket to, for example, a fence post. Web 128 terminates at side edges 132. In the embodiment shown, the bracket 122 is adapted to accommodate a pair of tensioning cylinders, as described below, but it will be understood that the tensioner may be formed to include only a single tensioning cylinder if so desired.

The upper and lower plate portions 124, 126 each have identical enlarged ends 134, 136. Ends 134 on the upper plate portion 124 are formed with cylinder openings (not visible) while ends 136 on the lower plate portion 126 are formed with cylinder openings 138, 140 that are vertically aligned with the similar openings in the upper plate portion, respectively. Openings 138, 140 are generally surrounded by a plurality of locking pin reaction holes 142, 144, respectively (four on each plate portion) while the openings in the upper plate portion 124 are surrounded by a similar plurality of locking pin reaction holes 146, 148. Opening 138 and the aligned opening in the upper plate portion receive a first tensioning cylinder 150 while opening 140 and the aligned opening in the upper plate portion receive a second tensioning cylinder 152. Since the tensioning cylinders are otherwise identical, only one need be described in detail.

Tensioning cylinder 150 comprises a hollow tube formed with a pair of opposed, elongated slots (one shown at 154) that extend substantially the entire length of the cylinder, i.e., at least the portion of the length between the upper and lower plate portions 124, 126. Circular flanges 156, 158 are attached (by welding, for example) to opposite ends of the cylinder 150, outside the plate portions 124, 126 and thus serve to retain the cylinder in place within the bracket. The circular flanges 156, 158 are each formed with a circular array of vertically aligned and selectively useable locking apertures 160, 162, respectively. Any vertically aligned pair of locking apertures 160, 162 may also be vertically aligned with a pair of vertically aligned locking pin reaction holes 142, 144 as described further below.

An elongated locking pin 164 has a bent end 166 that facilitates manipulation of the pin and also prevents the pin from sliding through, and out of, the upper and lower plate portions 124, 126 and respective flanges 156, 158 when used as described below.

In use, after a fence slat has been located in one or both of the slots 154, 156, a torque applying tool is located in a profiled hole 168 provided in the upper circular flange and rotated, thereby coiling the fence slat around the tensioning cylinder 150 to tighten or tension the slat. Note that hole 168 is coincident with the center axis of the cylinder 150. A similar hole is provided in the lower circular flange 158. When the slat has been tensioned to the desired degree, the pin 164 is inserted through a selected locking aperture 160 in the upper circular flange 156, an aligned pair of locking pin reaction holes 144, 142 in the upper and lower plate portions 124, 126, and an aligned locking aperture 162 in the lower circular flange 158, with the bent end 166 of pin 164 engaging the upper circular flange 156 to retain the pin in place.

It will be understood that the tensioning device as shown in FIGS. 8–11 will accommodate a pair of fence slats, each terminating at the fence tensioner installed, for example, on a post located somewhere between the ends of the fence. It will be appreciated, however, that one of the tensioning cylinders could be eliminated and the fence tensioner used to tighten a single slat at the end of the fence. Moreover, for multiple fence slats, the fence tensioners may be applied in a vertically spaced or stacked relationship on a single fence post.

Figure 11:
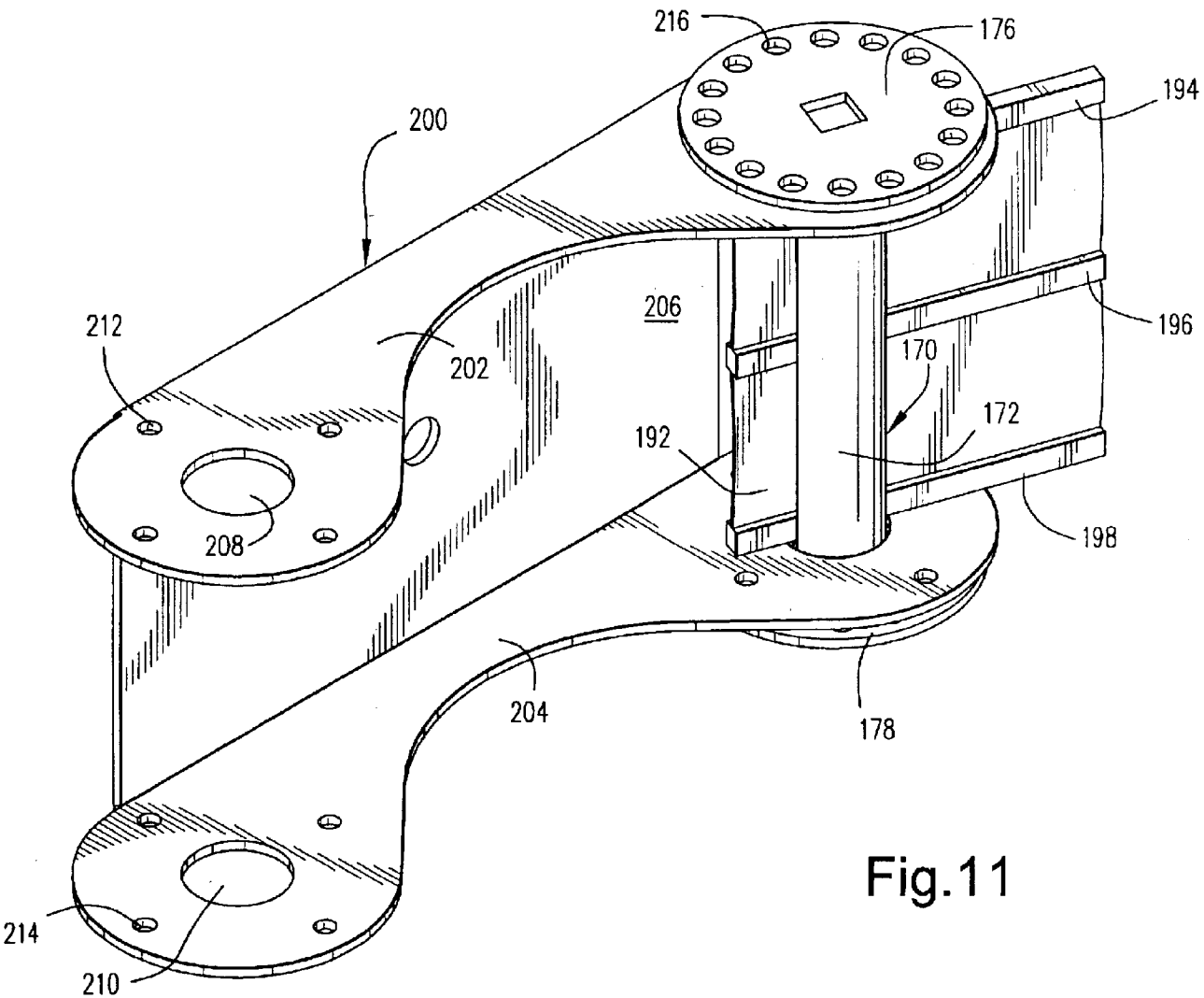
FIG. 11 is a perspective view of a partially assembled fence tensioner in accordance with a variation of the second exemplary embodiment.
Figure 12:
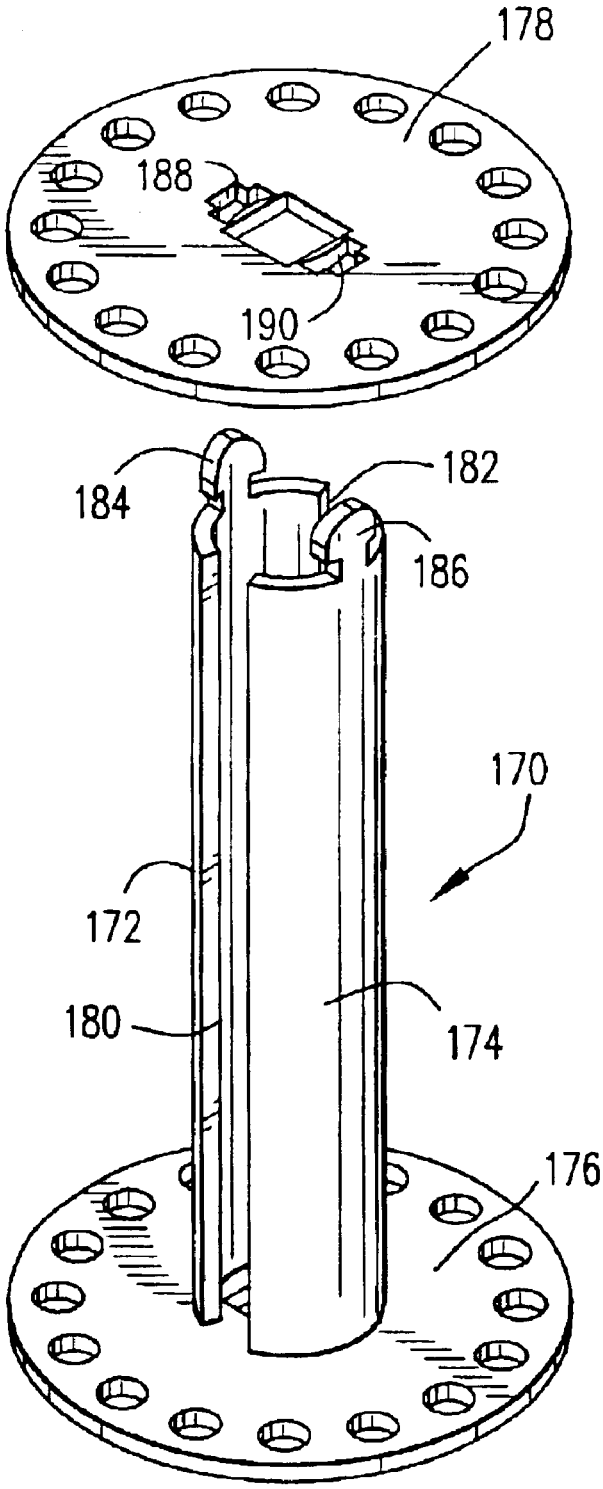
FIG. 12 is an exploded view of a tensioning cylinder for use with the fence tensioner shown in FIG. 11.

Turning to FIGS. 11 and 12, an alternative construction for the tensioning cylinders 150, 152 is shown. Here, a tensioning cylinder 170 is comprised of a pair of elongated generally semi-circular segments 172, 174, each having a circumference of about 170° such that, when assembled between upper and lower circular flanges 176, 178 (the cylinder is inverted in FIG. 12 for clarity), they will define opposed, elongated slots 180, 182 between them. In the preferred arrangement, first ends of the segments may be welded to the upper circular flange 176, while the opposite ends of the segments are formed with locking tabs 184, 186 that are adapted to be received in respective apertures 188, 190 in the lower circular flange 178. This arrangement facilitates easy assembly by inserting the cylinder into the bracket openings with the circular flange 176 on top. The lower circular flange 178 are then located over the lower end of the cylinder 170 with tabs 184, 186 fully seated in apertures 188, 190. The tabs 184, 186 are then bent outwardly to secure the lower circular flange in place. It will be appreciated that other fastening techniques may be employed as well.

It should be further noted that the width of the resulting slots 180, 182 is such that a fence slat end 192, and specifically the thickened ribs 194, 196, 198 that run along either side of the slat will be clamped between the segments 172, 174.

Note also that in this embodiment, the bracket 200 may be of one piece construction, with upper and lower plate portions 202, 204 bent transversely to the vertical web 206. The remainder of the tensioner including cylinder openings 208, 210, locking pin reaction holes 212, 214 and locking pin apertures 216 are similar to corresponding elements in FIGS. 8–10, and tensioning of one or two fence slats is achieved as described above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fence tensioner for applying tension to a substantially flat, flexible fence slat comprising a bracket adapted to be secured to a fence post, said bracket having a substantially vertical fence post mounting web between upper and lower horizontal plate portions with vertically aligned cylinder openings and vertically aligned locking pin reaction holes therein; a first tensioning cylinder received in said vertically aligned cylinder openings for rotation relative to said upper and lower horizontal plate portions, said first tensioning cylinder having at least one slot extending along said cylinder and a first pair of flanges at respective opposite ends thereof that retain said tensioning cylinder in said aligned cylinder openings, said slot having a length substantially equal to a width of the substantially flat, flexible fence slat, each of said first pair of flanges having a circular array of selectively useable locking apertures therein; and a locking pin adapted to extend through said aligned locking pin reaction holes and through a selected pair of aligned locking apertures.

2. The fence tensioner of claim 1 wherein said locking pin is formed with a bent end.

3. The fence tensioner of claim 1 wherein said upper and lower horizontal plate portions are formed with plural aligned pairs of said locking pin reaction holes.

4. The fence tensioner of claim 3 wherein said aligned locking pin reaction holes and said locking apertures have substantially equal diameters.

5. The fence tensioner of claim 1 wherein said first tensioning cylinder is comprised of a pair of adjacent, elongated and generally semi-circular segments, secured to and between said flanges, such that said slot is formed between said segments.

6. A fence tensioner comprising a bracket adapted to be secured to a fence post, said bracket having upper and lower horizontal plate portions with vertically aligned cylinder openings and vertically aligned locking pin reaction holes therein; a first tensioning cylinder received in said vertically aligned cylinder openings for rotation relative to said upper and lower horizontal plate portions, said first tensioning cylinder having at least one slot extending along said cylinder and a first pair of flanges at respective opposite ends thereof that retain said tensioning cylinder in said aligned cylinder openings, each of said first pair of flanges having a circular array of selectively useable locking apertures therein; and a locking pin adapted to extend through said aligned locking pin reaction holes and through a selected pair of aligned locking apertures; wherein said aligned cylinder openings are located at one end of said horizontal plate portions, and wherein a second pair of aligned cylinder openings are located at an opposite end of said horizontal plate portions, with a second tensioning cylinder received in said second pair of aligned shaft openings.

7. The fence tensioner of claim 6 wherein said second fence tensioning cylinder has at least one slot extending along said cylinder, and a second pair of flanges provided at respective opposite ends thereof.

8. The fence tensioner of claim 7 wherein each of said first and second pair of flanges is welded to said first and second tensioning cylinders, respectively.

9. The fence tensioner of claim 8 and further comprising a second locking pin adapted to extend through said aligned locking pin reaction holes and through a selected pair of said aligned locking apertures in said second fence tensioning cylinder.

10. The fence tensioner of claim 9 wherein said second locking pin has a bent end.

11. A fence tensioner comprising a bracket adapted to be secured to a fence post, said bracket having upper and lower horizontal plate portions with vertically aligned cylinder openings and vertically aligned locking pin reaction holes therein; a first tensioning cylinder received in said vertically aligned cylinder openings for rotation relative to said upper and lower horizontal plate portions, said first tensioning cylinder having at least one slot extending along said cylinder and a first pair of flanges at respective opposite ends thereof that retain said tensioning cylinder in said aligned cylinder openings, each of said first pair of flanges having a circular array of selectively useable locking apertures therein; and a locking pin adapted to extend through said aligned locking pin reaction holes and through a selected pair of aligned locking apertures; wherein said first tensioning cylinder is comprised of a pair of adjacent, elongated and generally semi-circular segments, secured to and between said flanges, such that a fence slat receiving slot is formed between said segments; and wherein said pair of segments are welded at first ends to one of said first pair of flanges and mechanically secured at second, opposite ends to the other of said first pair of flanges.

12. A fence tensioner for applying tension to a substantially flat, flexible fence slat comprising a bracket adapted to be secured to a fence post, said bracket having upper and lower horizontal plate portions with vertically aligned cylinder openings and vertically aligned locking pin reaction holes therein; a tensioning cylinder received in said vertically aligned cylinder openings for rotation relative to said upper and lower horizontal plate portions, said tensioning cylinder formed by a pair of adjacent, elongated and generally semi-circular segments, secured to and between a pair of end flanges located outside said upper and lower horizontal plate portions, said cylinder having an elongated slot formed between said segments, said slot sized to receive said substantially flat, flexible fence slat, each of said end flanges having a circular array of selectively useable locking apertures therein; and a locking pin adapted to extend through said aligned locking pin holes and through a selected pair of aligned locking apertures.

13. The fence tensioner of claim 12 wherein said bracket includes a vertical web extending between said upper and lower horizontal plate portions, at rearward ends thereof.

14. A fence tensioner comprising a bracket adapted to be secured to a fence post, said bracket having upper and lower horizontal plate portions with vertically aligned cylinder openings and vertically aligned locking pin reaction holes therein; a tensioning cylinder received in said vertically aligned cylinder openings for rotation relative to said upper and lower horizontal plate portions, said tensioning cylinder formed by a pair of adjacent, elongated and generally semi-circular segments, secured to and between a pair of end flanges, such that a fence slat receiving slot is formed between said segments, each of said end flanges having a circular array of selectively useable locking apertures therein; and a locking pin adapted to extend through said aligned locking pin holes and through a selected pair of aligned locking apertures; wherein said pair of segments are welded at first ends to one of said pair of flanges and mechanically secured at second, opposite ends to the other of said pair of flanges.

15. A fence tensioner comprising a bracket adapted to be secured to a fence post, said bracket having upper and lower horizontal plate portions with vertically aligned cylinder openings and vertically aligned locking pin reaction holes therein; a tensioning cylinder received in said vertically aligned cylinder openings for rotation relative to said upper and lower horizontal plate portions, said tensioning cylinder formed by a pair of adjacent, elongated and generally semi-circular segments, secured to and between a pair of end flanges, such that a fence slat receiving slot is formed between said segments, each of said end flanges having a circular array of selectively useable locking apertures therein; and a locking pin adapted to extend through said aligned locking pin holes and through a selected pair of aligned locking apertures; wherein said aligned cylinder openings are located at one end of said horizontal plate portions, and wherein a second pair of aligned cylinder openings are located at an opposite end of said horizontal plate portions, with a second tensioning cylinder received in said second pair of aligned cylinder openings.

* * * * *